United States Patent [19]

McCalmont

[11] 4,195,202

[45] Mar. 25, 1980

[54] VOICE PRIVACY SYSTEM WITH AMPLITUDE MASKING

[75] Inventor: Arnold M. McCalmont, Acton, Mass.

[73] Assignee: Technical Communications Corporation, Concord, Mass.

[21] Appl. No.: 866,244

[22] Filed: Jan. 3, 1978

[51] Int. Cl.[2] ..... H04K 1/04

[52] U.S. Cl. ..... 179/1.5 S; 179/1.5 R

[58] Field of Search ..... 179/1.5 R, 1.5 M, 1.5 S

[56] References Cited

U.S. PATENT DOCUMENTS

| | | | |
|---|---|---|---|
| 1,819,614 | 8/1931 | Mathes | 179/1.5 R |
| 1,921,063 | 8/1933 | Affel | 179/1.5 M |
| 2,411,683 | 11/1946 | Guanella | 179/1.5 R |
| 3,201,517 | 8/1965 | Gannett | 179/1.5 R |
| 3,723,878 | 3/1973 | Miller | 179/1.5 R |
| 3,879,578 | 4/1975 | Wildi | 179/1.5 R |
| 4,068,094 | 1/1978 | Affel | 179/1.5 R |
| 4,099,027 | 7/1978 | Whitten | 179/1.5 R |

*Primary Examiner*—Howard A. Birmiel

*Attorney, Agent, or Firm*—Cesari & McKenna

[57] ABSTRACT

A voice privacy system enhances the privacy of a transmission by disguising the amplitude characteristics and cadence content of transmitted voice signals. Encoding apparatus first divides a voice signal to be transmitted into two or more frequency bands. One or more of the frequency bands is frequency inverted, delayed in time relative to the other frequency bands and then recombined with the other frequency bands to produce a composite signal for transmission to a remote receiver. By selecting the magnitude of the delay to approximate the time constants of the cadence, or intersyllabic and phoneme generation rates, of the speech to which the voice signal corresponds, the amplitude fluctuations of the composite signal are substantially lessened and the cadence content of the signal is effectively disguised. It thus becomes extremely more difficult for unauthorized listeners to extract cadence information from the signal as a means of extracting intelligence from the signal. Decoding apparatus at the receiver reconstitutes the original voice signal.

16 Claims, 5 Drawing Figures

VOICE PRIVACY SYSTEM WITH AMPLITUDE MASKING

BACKGROUND OF THE INVENTION

This invention relates generally to voice privacy systems and, more particularly, to a voice privacy system adapted to enhance the privacy of a transmission by disguising the amplitude characteristics of transmitted encoded signals.

Privacy systems are well known for rendering audio signals, particularly voice signals, unintelligible for transmission over an exposed transmission link so as to maintain the transmission private and to avoid reconstruction of the signal content by unauthorized listeners. In such systems, the voice signals are typically encoded at a transmitting site using an encoding technique that involves scrambling or displacing the signals in the frequency domain, time domain or both. At receiving site, the scrambled signals are decoded by, in effect, reversing the encoding procedure to recover the original signals. Ideally, in any system of this type, the encoding technique used should make it extremely difficult for unauthorized listeners to decode or "break" an intercepted scrambled signal, yet still permit recovery at the receiving site of the transmitted information with good intelligibility and recognition by authorized listeners.

Most encoding techniques presently in use, whether involving frequency scrambling, time scrambling or both, have difficulty disguising amplitude variations in the transmitted signals. This can be particularly problematic with voice signals since the amplitude of the typical voice signal varies in a more or less regular manner that is related to the cadence and intersyllabic rate of speech and the presence of certain well defined, recurring phonemes. A simple illustration is a number count of one to ten. Under most conditions, a listener, by analyzing the cadence of a scrambled signal, can determine that a series of numbers is being counted, even though the frequency content of the signal has been severely disturbed. Information that an unauthorized listener is able to extract from a scrambled signal concerning its cadence, pauses and interruptions can serve as a starting point for further breakdown of the signal. Thus, to provide enhanced levels of privacy and security, it is desirable to utilize encoding techniques that effectively mask or disguise the amplitude characteristics of the transmitted signals.

A variety of attempts have heretofore been made for disguising amplitude characteristics in privacy systems. One of the most straightforward techniques that has been used for this purpose involves severely limiting the amplitude of the signals prior to their transmission. This technique, however, is only partially effective at best, as it does not hide complete pauses in the signals. Amplitude limitation of the transmitted signals also generally makes it more difficult to detect and completely recover the original signals at the receiving side of the system.

Time division privacy systems of the type described, for example, in U.S. Pat. No. 3,824,467, also provide some degree of amplitude masking. In systems of this type, the voice signals are first divided into small time increments and the time increments are then rearranged to form an unintelligible transmitted signal. Time division scrambling systems, however, generally require components that temporarily store the various signal increments and components that selectively control the storage components to effect the rearrangement of the increments. These components must be present at both the transmitting and receiving side of the system and add significantly to the complexity and cost of the system. Additionally, time division privacy systems are still only partially effective in disguising amplitude variations in the signals, for complete pauses that fall within individual time increments still remain as pauses in the transmitted signals.

Another approach to the amplitude masking problem is that described in U.S. Pat. No. 3,978,288. In accordance with the technique described in that patent, filling signals having characteristics corresponding to those of the voice signals to be transmitted are selectively inserted into the pauses normally encountered in the voice signals as a means of masking or disguising the pauses. The insertion of the filling signals may take place either before or after the signals are encoded. As can be appreciated from a review of U.S. Pat. No. 3,978,288, the apparatus necessary to implement the filling signal insertion technique is rather complex and expensive. The filling signal insertion technique is also disadvantaged by the fact that a decoding signal must be transmitted with the encoded voice signal but in a separate channel to enable the removal or suppression of the filling signals at the receiving site. Additionally, the filling signal insertion technique is only effective in disguising complete pauses in the transmitted signals. Amplitude variations in the non-zero, speech portions of the transmitted signals are not affected by the filling signals.

OBJECTS OF THE INVENTION

Accordingly, it is a broad object of the present invention to provide an improved voice privacy system.

A more specific object of the invention is to provide an improved voice privacy system that enhances the privacy of a transmission by disguising the amplitude characteristics of the transmitted voice signals so as to prevent use of such characteristics by unauthorized listeners in the extraction of intelligence from the signals.

Another object of the invention is to provide an improved voice privacy system that effectively disguises the amplitude characteristics of transmitted voice signals without the need for expensive signal storage components and associated control components either at the transmitting or receiving side of the system.

Still another object of the invention is to provide an improved voice privacy system of the type described that does not require the transmission of a separate decoding signal with the encoded transmission signal to enable recovery of the original voice signals at the receiving site.

SUMMARY OF THE INVENTION

The present invention is based upon the realization that the amplitude variations of voice signals to be transmitted in a private mode can be effectively disguised using a relatively simple frequency bandsplitting and time delay encoding technique.

A privacy system embodied in accordance with the invention first divides a voice signal to be transmitted into two or more separate frequency bands. One or more of the frequency bands is then delayed in time relative to the other bands and the bands, both delayed and undelayed, are then recombined for transmission. It has been found that if the magnitude of the delay is properly selected, a delayed band will fill in the low amplitude portions of the undelayed bands to produce a resultant signal having an amplitude distribution that is substantially more smooth and regular than that of a normal speech signal. It thus becomes extremely difficult for an unauthorized listener to extract cadence information from the resultant signal as a means of extracting intelligence from the transmission. In order to provide effective amplitude smearing, the magnitude of the delay is selected so that it corresponds as closely as possible to the time constants of the cadence, or intersyllabic and phoneme generation rates, of the voice being transmitted. For normal speech, these time constants are typically in the range of about 50 to 150 milliseconds and the delay is accordingly selected to be within this range.

To provide an even greater degree of amplitude smearing in the resultant signal, one or more of the frequency bands may be inverted so that its energy distribution profile more closely corresponds to that of the other bands. The inversion is preferably performed by phase modulating the band to be inverted with a single pure inversion tone and subsequently filtering out the upper sideband modulation products. The filtered modulated signal consists of a lower sideband only, having the characteristic that the frequency components of the band are inverted; that is, the low frequency components of the band are translated to the high frequency end of the modulated signal and the high frequency components are translated to the low frequency end of the modulated signal. The inverted band may then be delayed by passing it through a suitable delay device, such as a charge coupled delay line, and summed with the uninverted, undelayed bands to produce the resultant signal for transmission.

At the receiving side of the system, and original voice signal is recovered by reversing the encoding technique utilized at the transmitting side. Specifically, the received signal is filtered to separate the delayed, inverted band from the undelayed, uninverted bands. The undelayed, uninverted bands are then subjected to a delay of magnitude equal to that that was used at the transmitting side to bring the bands back into time coincidence. The delayed, inverted band is re-inverted again using a phase modulator and sideband filter combination and summed with the other bands to reconstitute the original voice signal.

BRIEF DESCRIPTION OF THE DRAWING

The foregoing and other objects, features and advantages of the invention will be better understood from the following detailed description taken in conjunction with the accompanying drawing in which.

DETAILED DESCRIPTION OF ILLUSTRATIVE EMBODIMENT

Figure 1:
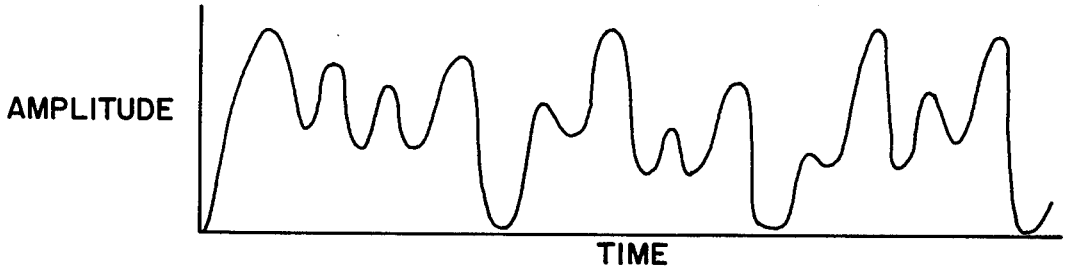
FIG. 1 is a waveform illustration of the amplitude versus time distribution of a voice signal corresponding to clear, normal speech.
Figure 2:
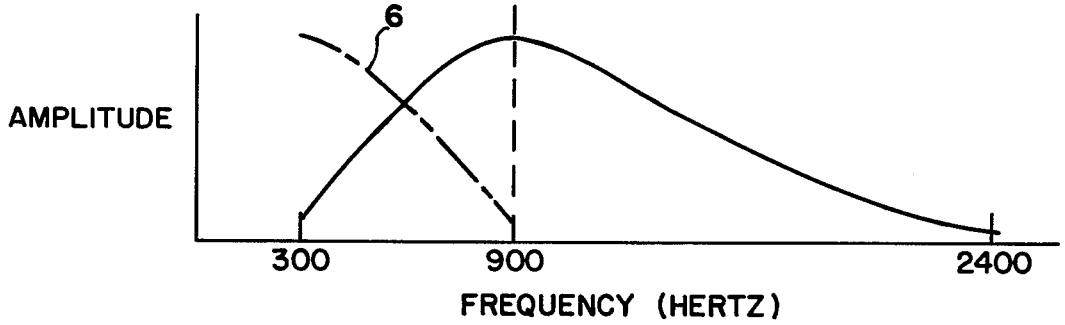
FIG. 2 is a waveform illustration of the amplitude versus frequency distribution of normal speech.
Figure 4:
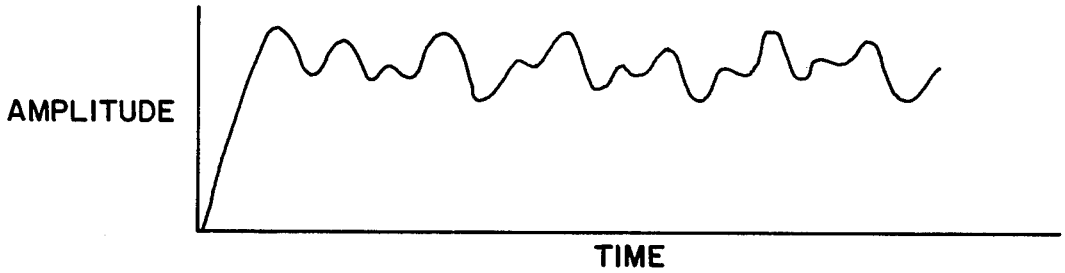
FIG. 4 is a waveform illustration of the amplitude versus time distribution of a voice signal which has been encoded using the apparatus of FIG. 3.

Before proceeding with a more detailed description of illustrative apparatus for implementing the amplitude disguising technique of the invention, reference is first made to FIGS. 1 and 2 of the drawing. FIG. 1 illustrates the amplitude wave shape of a typical voice signal corresponding to clear, normal speech, while FIG. 2 illustrates a typical frequency distribution of a normal speech signal. The significance of the dash-dotted curve labeled 6 in FIG. 2 will be explained below.

As is known, speech is highly complex and the exact amplitude and frequency characteristics of signals that correspond to speech depend upon a wide variety of factors, including, for example, the unique physical characteristics of the particular speaker. Voice signal studies indicate, however, that, for a given common spoken passage, there are distinct similarities among signals irrespective of the source of the signals. These similarities are primarily related to the cadence of the speech and consequently to the rate of fluctuation of the amplitude of the signals corresponding thereto.

As indicated in FIG. 1, a typical voice signal oscillates with time with a series of positive going and negative going peaks. For a given common spoken passage, the absolute magnitudes of these peaks generally vary from signal to signal, but the time occurrence of the peaks tend to be more or less regular. Amplitude fluctuations tend to occur at rates that are more strongly determined by the particular content of the speech than by the characteristics of the particular speaker. The rates at which amplitude variations take place relate to the intersyllabic rate of the speech content and the presence therein of certain well defined, recurring phonemes. Generally, for normal speech, the peaks and troughs of corresponding signals tend to be spaced by time increments in the range of about 50 to about 150 milliseconds.

There are also various aspects of the frequency content of normal speech signals that tend to be common from signal to signal. For example, as suggested by FIG. 2, substantially all of the voice signal energy is concentrated between frequencies of about 300 Hertz (Hz) and about 2400 Hz. Maximum voice energy tends to occur at about 900 Hz.

As previously noted, speech uniformities of this type, and particularly the cadence uniformity, present a problem in privacy systems. An unauthorized listener who is able to intercept an encoded signal and extract cadence information therefrom is generally able to draw assumptions concerning the signal content that are useful in further decoding of the signal. As a result, unless the cadence information is adequately disguised, the privacy and security of the transmission are significantly reduced.

Figure 3:
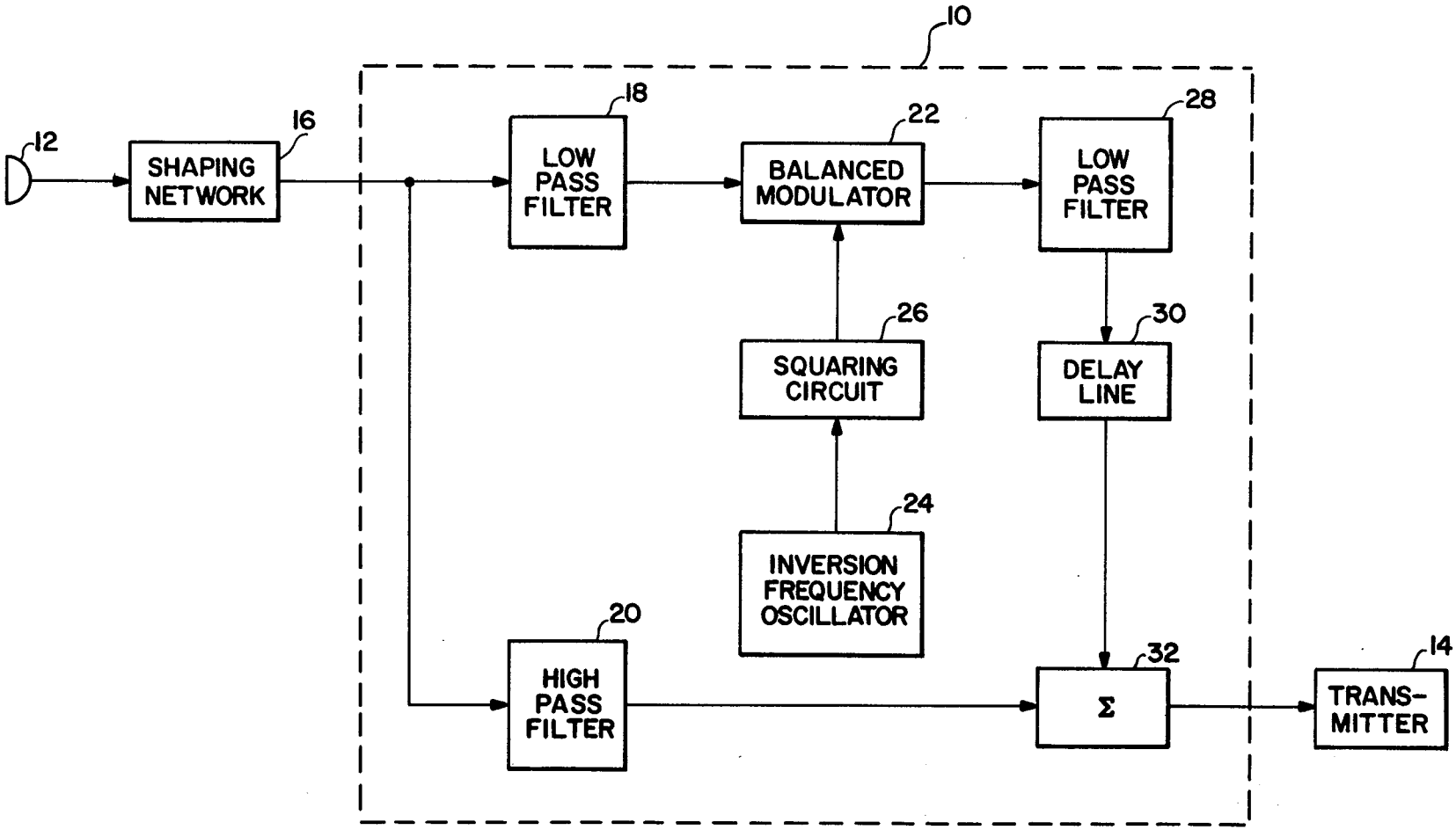
FIG. 3 is a block diagrammatic illustration of a voice signal transmitting station including a simple, two band privacy encoding apparatus embodied in accordance with the invention.

FIG. 3 illustrates apparatus, generally designated by the reference numeral 10, for implementing the amplitude disguising technique of the invention located at a transmitting side of a privacy transmission system. The apparatus 10 is interposed between an audio signal source 12, illustratively shown as a microphone, and a transmitter 14. The audio signal from the source 12 is fed through a waveshaping network 16 for filtering out those signal components that may lie outside the bandwidth of the signal to be transmitted. For example, when speech is to be transmitted, the network 16 may include filter elements which attenuate frequencies below 300 Hz and above 2400 Hz, which is thus the bandwidth to which the encoding apparatus 10 must be accommodated.

After passage through the network 16, the audio signal is applied to a low-pass filter 18 within the encoding apparatus 10. The low-pass filter 18 filters from the signal those frequency components above a certain predetermined cutoff frequency $f_{18}$ and passes those frequency components below the cutoff frequency $f_{18}$. For voice signals having the frequency characteristics represented in FIG. 2, the cutoff frequency $f_{18}$ may illustratively be selected to be 900 Hz. Thus, only those frequency components of the audio signal from about 300 Hz to 900 Hz are passed by the filter 18.

The audio signal is also applied to a high-pass filter 20 in the apparatus 10 which passes only those frequency components above its predetermined cutoff frequency $f_{20}$. The cutoff frequency $f_{20}$ of the high-pass filter 20 is also illustratively selected to be 900 Hz so that only those frequency components in the range of 900 Hz to about 2400 Hz are passed by the filter 20. The audio signal is thus split by the apparatus 10 into a high frequency band and a low frequency band separated by the 900 Hz cutoff.

The apparatus 10 next delays one of the frequency bands relative to the other frequency band of the signal to achieve amplitude smearing. The delaying operation is illustratively performed on the low frequency band at the output of filter 18. However, prior to effecting the delaying operation, the apparatus 10 is adapted to frequency invert the lower frequency band so that its energy distribution profile more closely corresponds to that of the higher frequency band. The reason for the inversion may better be appreciated by referring again to FIG. 2. The dash-dotted line labeled 6 in FIG. 2 illustrates the amplitude versus frequency distribution of the lower frequency band of the signal after it has been inverted. In the inverted form of the lower frequency band, most of the energy is concentrated at the lowest frequency cutoff and the relative energy decreases as the upper frequency cutoff is approached. The frequency distribution of the inverted form of the lower frequency band thus resembles that of the higher frequency band and this resemblance has been found to improve the amplitude masking that is achieved in the final transmitted signal.

To effect the inversion of the lower frequency band, the output of low-pass filter 18 is applied to a phase modulator 22 where it is modulated with a carrier supplied to the modulator 22 from an oscillator 24 through a squaring circuit 26. The oscillator 24 generates a sinusoidal output at a single frequency called the "inversion" frequency. This output is converted by the squaring circuit 26 to a signal which is substantially a square wave and which drives the modulator 22 on and off at precisely defined times. The modulator 18 may advantageously comprise a pair of transistor switches arranged in a balanced configuration and followed by a difference amplifier having its inputs connected to the respective switch outputs. In the time domain, the output of the modulator 22 is an analog of its input in which successive segments are shifted by 180° in accordance with the applied inversion signal. In the frequency domain, the output of the modulator 22 comprises upper and lower sidebands centered around the fundamental inversion frequency of the oscillator 22 and its higher harmonics as contained in the square wave. For voice signals of the type herein involved concentrated in a 300 to 2400 Hz passband, the inversion frequency of the oscillator 24 may be selected to be at 1200 Hz.

The output of modulator 22 is applied to a low-pass filter 28 which filters out the upper sideband positioned above the fundamental inversion frequency together with all other modulation products centered around higher frequencies. The output of the low-pass filter 28 is thus an inverted form of the lower frequency band having the frequency characteristics illustrated by the dash-dotted line 6 in FIG. 2.

The delaying operation is now effected on the inverted lower frequency band of the audio signal. Thus, the output of filter 28 is applied to a suitable time delay device, such as delay line 30. The time delay of the device 30 is selected to be comparable to the time constants of the cadence, or intersyllabic and phoneme generation rates, of the speech to which the input audio signal corresponds. As previously noted, these time constants for normal speech are typically in the range of about 50 to 150 milliseconds. The time delay of the device 30 is thus selected within this range, with a delay of about 80 milliseconds being typical.

The delay line 30 may advantageously be in the form of a charge coupled delay line device.

The inverted, delayed lower frequency band of the input audio signal is recombined with the higher frequency band of the signal (i.e., the output of high-pass filter 20) in a summer 32. The output of the summer 32 thus comprises a composite signal corresponding to the input audio signal but in which there is a displacement or shifting in time of different signal frequencies. This composite signal is applied to the transmitter 14 for transmission to a remote receiver.

Because the delay time introduced by the device 30 is selected to approximate the time constants of the cadence, intersyllabic and phoneme generation rates of the speech to which the input audio signal corresponds, the amplitude characteristics of the transmitted composite signal will be substantially more smooth and regular than those of the original signal. This is because the higher amplitude portions of the inverted, delayed, lower frequency band appear at times in the composite signal corresponding to the times of occurrence of the lower amplitude portions of the higher frequency band. The result can better be appreciated by comparing FIG. 1 to FIG. 4, the latter of which illustrates graphically the amplitude versus time distribution of the signal shown in FIG. 1 after it has passed through the apparatus 10 and as it appears at the output of the summer 32. The resultant amplitude smearing, while not perfect, is highly effective in disguising the cadence content of the transmitted signal and in removing the ability to extract intelligence from the signal based upon cadence.

The encoding apparatus 10 may be used without additional encoding equipment, as described above, in transmission systems requiring only short-term privacy or security. Alternatively, the apparatus 10 may be used in conjunction with more complicated and involved encoding apparatus that is capable of providing greater degrees of time domain scrambling, frequency domain scrambling or both, but not capable of adequately disguising the amplitude characteristics of the scrambled signals. The apparatus 10 may also be used with both wireless transmission systems and systems including wire or waveguide transmission links. When, for example, the apparatus 10 is used in a mobile two-way radio communication system, the transmitter 14 will typically be adapted to perform appropriate wave shaping and frequency translating and modulating operations to enable the composite signal to be transmitted to the remote receiver on a radio frequency carrier signal. When the transmission link is to comprise a telephone transmission line, on the other hand, the transmitter 14 need not necessarily contain frequency translating circuitry and may in fact be eliminated altogether.

Figure 5:
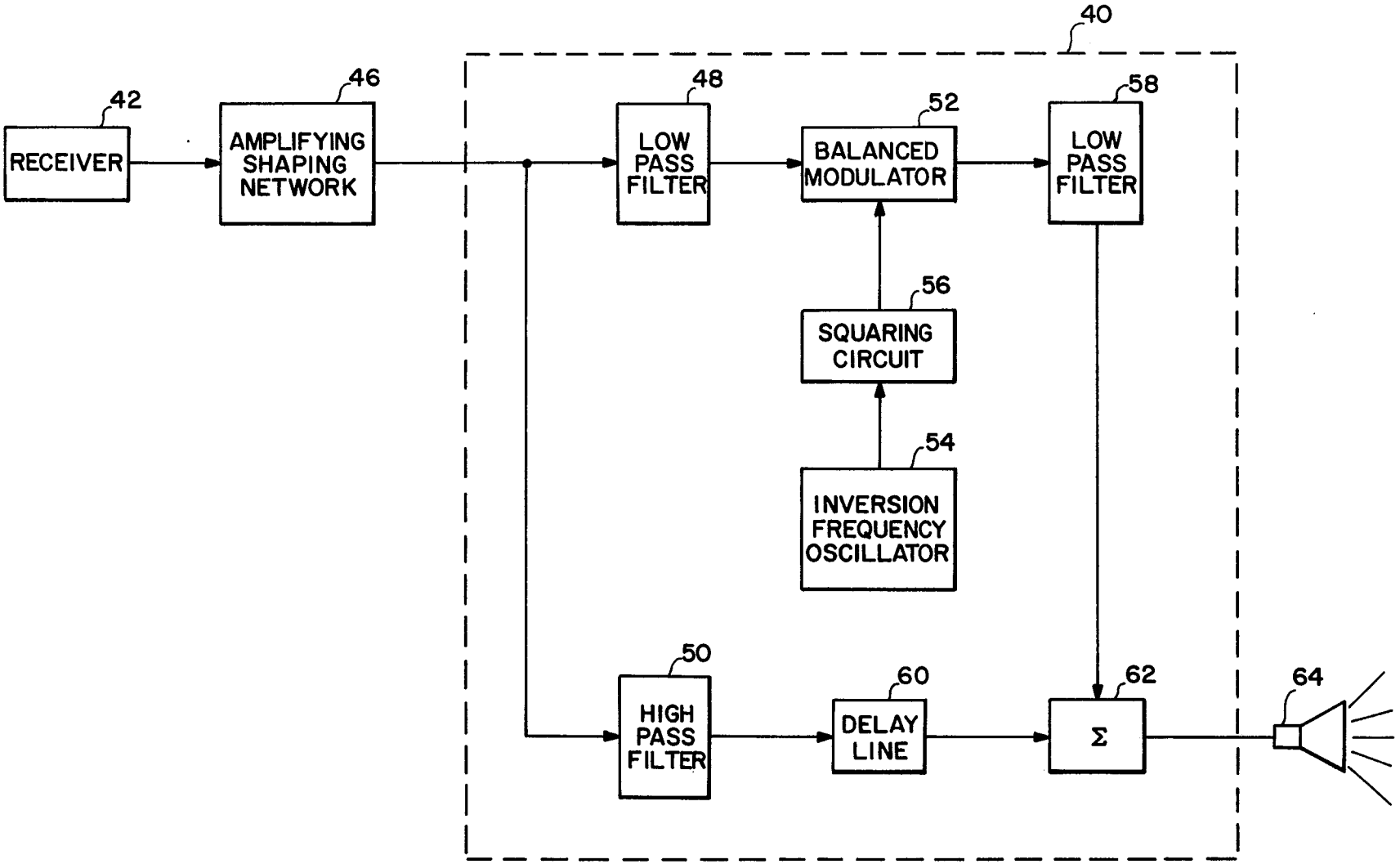
FIG. 5 is a block diagrammatic illustration of a voice signal receiving station including a simple, two band privacy decoding apparatus embodied in accordance with the invention and adapted to reconstitute the voice signals transmitted by the apparatus of FIG. 1.

FIG. 5 illustrates decoding apparatus 40 embodying the invention at the receiving side of a privacy system for recovering the original audio signal transmitted by the equipment of FIG. 3. In FIG. 5, the transmitted signal is received by a receiver 42 and passed through a conventional amplifying, shaping (and demodulating, if necessary) network 46 prior to entering the decoding apparatus 40. In the apparatus 40, the composite signal is passed through a low-pass filter 48 and a high-pass filter 50 having cutoff frequencies $f_{48}$ and $f_{50}$, respectively, of 900 Hz to split the signal into its lower frequency band and higher frequency band. The lower frequency band is reinverted by the combination of modulator 52, oscillator 54, squaring circuit 56 and low-pass filter 58 which are illustratively identical to the correspondingly named components in the encoding apparatus 10 of FIG. 3 and referenced by numerals 30 units lower than those shown in FIG. 5. The higher frequency band is delayed in a delay line 60 which is illustratively identical to the delay line 30 of FIG. 3 to bring the higher frequency band into time coincidence with the lower frequency band. Both bands are then recombined in a summer 62 to reconstitute the original audio signal. The reconstituted signal is passed to an output utilization device, such as a speaker 64, to enable reception of the transmitted information by an authorized listener.

From the foregoing, it will be appreciated that an improved voice privacy encoding technique and apparatus for implementing that technique have been described which achieve enhanced levels of privacy by effectively disguising signal amplitude characteristics in a manner that is both relatively simple and inexpensive to implement as compared to similar prior systems. It should be understood, however, that the foregoing description is intended only to illustrate the principles of the invention and that modifications to the described apparatus may be made by those skilled in the art without departing from the intended scope of the invention as defined by the appended claims. For example, while a simplified apparatus has been shown and described that splits the audio signal to be transmitted into a high and a low frequency band and that delays the low frequency band relative to the high frequency band, it should be noted that it is possible, and may be desirable in order to achieve greater degrees of amplitude masking, to split the audio signal into three or more separate frequency bands and to delay two or more of such bands. Different delays may also be used for different bands. For example, one band may be delayed by 50 milliseconds, another by 100 milliseconds and a third not delayed at all. Also, the lower frequency bands need not be the ones that are delayed. The desired amplitude masking can also be achieved by delaying the higher frequency bands. The same holds true for the band inverting process; any of the bands, whether of high or low frequency, and whether delayed or undelayed, may be inverted.

Additionally, it may be desirable to vary the magnitude of the time delay that is introduced into one or more of the bands during the course of a transmission either to enhance the privacy of the transmission or to better match the delay to changing cadence characteristics of the particular voice signal source. In such a case, the delay lines 30 and 60 could advantageously be made adjustable and a delay indicating signal could be transmitted as part of the composite signal to the receiver where the delay indicating signal may be used in adjusting the delay line 60 in accordance with adjustments to the delay line 30. Similar changes may desirably be made to the inversion frequency produced by the oscillator 24 of FIG. 3 and a signal indicative of the inversion frequency changes may likewise be transmitted as part of the composite signal for utilization at the receiver. Techniques for transmitting and recovering synchronizing signals of these types are well known in the art (see, for example, U.S. Pat. No. 3,723,878, which is assigned to the assignee hereof) and may be readily incorporated in the apparatus described herein.

Furthermore, it should be understood that any variable amplitude analog information signal may be sent in privacy with the foregoing apparatus whether or not arising from a voice source while still realizing the indicated advantages of the invention.

What I claim as new and desire to secure by Letters Patent of the United States is:

1. Apparatus for encoding a variable amplitude analog information signal in the audio frequency range for transmission in a privacy mode to a remote receiver where the signal is to be recovered in a clear mode, the analog information signal comprising a voice signal corresponding to speech having a discernible cadence and intersyllabic generation rate, said apparatus comprising:

A. means for splitting the voice signal into at least two separate frequency bands;

B. means for time delaying at least one of said frequency bands relative to the other of said frequency bands by a predetermined time delay increment;

C. means for recombining said time delayed frequency band with the other of said frequency bands to produce a composite signal for transmission; and D. said predetermined time delay increment being selected so that it approximates in value the time constant of the cadence and intersyllabic generation rate of the speech so that relatively high amplitude portions of said delayed frequency band appear in said composite signal at times of occurrence of relatively low amplitude portions of the other of said frequency bands to provide substantial amplitude smearing in said composite signal.

2. Apparatus as recited in claim 1 in which said frequency band splitting means splits the voice signal into a low frequency band and a high frequency band and comprises a low pass filter responsive to the voice signal for producing the low frequency band and a high pass filter responsive to the voice signal for producing the high frequency band.

3. Apparatus as recited in claim 1 further including:

E. means for frequency inverting said one of said frequency bands that is delayed by said time delay means so that the energy versus frequency profile of the delayed band more closely corresponds to the energy versus frequency profile of the undelayed band.

4. Apparatus as recited in claim 3 in which said frequency inverting means comprises i. an oscillator for producing an output signal at an inversion frequency, ii. a phase modulator responsive to said oscillator output signal for phase modulating said one of said frequency bands in accordance with said oscillator output signal to produce upper and lower sideband modulation products centered around the inversion frequency, and iii. a low pass filter for filtering the upper sideband modulation products from the output of said phase modulator.

5. Apparatus as recited in claim 4 in which said time delaying means comprises a delay line device connected to delay the output of said low pass filter in said frequency inverting means by said predetermined time delay increment.

6. Apparatus as recited in claim 4 in which said frequency inverting means further includes iv. a squaring circuit for converting said oscillator output signal substantially to a square wave prior to application to said phase modulator.

7. Apparatus as recited in claim 1 in which said predetermined time delay increment is selected from the range of about 50 to about 150 milliseconds.

8. Apparatus as recited in claim 7 in which said predetermined time delay increment is selected to be about 80 milliseconds.

9. Apparatus as recited in claim 1 in which the voice signal has a frequency bandwidth from about 300 Hertz to about 2400 Hertz and maximum energy at about 900 Hertz and in which said frequency band splitting means splits the voice signal into a low frequency band from about 300 Hertz to about 900 Hertz and a high frequency band from about 900 Hertz to about 2400 Hertz.

10. Apparatus as recited in claim 1 further including

F. means at the remote receiver for recovering the original voice signal from said composite signal comprising i. means for splitting the composite signal into said two separate frequency bands, ii. means for time delaying the other of said frequency bands by said predetermined time delay increment to bring the other of said frequency bands back into time coincidence with said one of said frequency bands, and iii. means for recombining said two frequency bands to reconstitute the original voice signal.

11. Apparatus as recited in claim 3 further including

F. means at the remote receiver for recovering the original voice signal from said composite signal comprising i. means for splitting the composite signal into said two separate frequency bands, ii. means for frequency re-inverting said one of said frequency bands, iii. means for time delaying the other of said frequency bands by said predetermined time delay increment to bring the other of said frequency bands back into time coincidence with said one of said frequency bands, and iv. means for recombining said two frequency bands to reconstitute the original voice signal.

12. A technique for encoding a variable amplitude analog information signal in the audio frequency range for transmission in a privacy mode to a remote receiver where the signal is to be recovered in a clear mode, said analog information signal comprising a voice signal corresponding to speech having a discernible cadence and intersyllabic generation rate, said technique comprising the steps of:

A. splitting the voice signal into at least two separate frequency bands;

B. time delaying at least one of said frequency bands relative to the other of said frequency bands by a predetermined time delay increment; and C. recombining said time delayed frequency band with the other of said frequency bands to produce a composite signal for transmission;

D. said predetermined time delay increment being selected so that it approximates in value the time constant of the cadence and intersyllabic generation rate of the speech so that relatively high amplitude portions of said delayed frequency band appear in said composite signal at times of occurrence of relatively low amplitude portions of the other of said frequency bands to provide substantial amplitude smearing in said composite signal.

13. A technique as recited in claim 12 further including the step of:

E. frequency inverting said one of said frequency bands that is time delayed so that the energy versus frequency profile of the delayed band more closely corresponds to the energy versus frequency profile of the undelayed band.

14. A technique as recited in claim 12 in which said predetermined time delay increment is selected from the range of about 50 to about 150 milliseconds.

15. A technique as recited in claim 14 in which said predetermined time delay increment is selected to be about 80 milliseconds.

16. A technique as recited in claim 12 in which the voice signal has a frequency bandwidth from about 300 Hertz to about 2400 Hertz and maximum energy at about 900 Hertz and in which said frequency band splitting step comprises splitting the voice signal into a low frequency band from about 300 Hertz to about 900 Hertz and a high frequency band from about 900 Hertz to about 2400 Hertz.

* * * * *